US006241555B1

(12) United States Patent
Okuyama et al.

(10) Patent No.: US 6,241,555 B1
(45) **Date of Patent: *Jun. 5, 2001**

(54) SHELLED CONNECTOR MOUNTED ON ELECTRIC EQUIPMENT

(75) Inventors: Takeshi Okuyama, Nagano; Kazuyuki Futaki, Suzaka, both of (JP)

(73) Assignee: Fujitsu Takamisawa Component Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/780,104

(22) Filed: Dec. 24, 1996

(30) Foreign Application Priority Data

Aug. 7, 1996 (JP) ..... 8-208545

(51) Int. Cl.[7] ..... H01R 13/648
(52) U.S. Cl. ..... 439/607; 439/108
(58) Field of Search ..... 439/607–610, 439/108, 101

(56) References Cited

U.S. PATENT DOCUMENTS 4,550,960 * 11/1985 Asick et al. ..... 439/108
5,094,627 * 3/1992 Uekido ..... 439/610
5,207,597 * 5/1993 Klein et al. ..... 439/607
5,254,010 * 10/1993 Davis ..... 439/108
5,470,238 * 11/1995 Walden ..... 439/607
5,637,015 * 6/1997 Tan et al. ..... 439/607
5,655,932 * 8/1997 Breitschaft et al. ..... 439/607
5,676,569 * 10/1997 Davis ..... 439/609
5,755,595 * 5/1998 Davis et al. ..... 439/609
5,766,041 * 6/1998 Morin et al. ..... 439/609

* cited by examiner

*Primary Examiner*—Hien Vu
(74) *Attorney, Agent, or Firm*—Staas & Halsey LLP

(57) ABSTRACT

An internal shelled connector, mounted on electric equipment having a grounded chassis panel, for mating with an external cable connector. The connector is encapsulated by a conducting shell for electrostatic shield, except at an opening for receiving the external connector through a corresponding window of the panel. A contact, formed on the shell maintains pressure on a back surface of the panel to ground the shell. The contact may be a flange formed at a tip of a blade spring formed integrally continuous with the conducting shell. The flange maintains a persistent electric contact with the panel, even if the panel and the mounted shelled connector are partially separated due to mechanical stress, when plugging in or pulling out the external cable connector.

7 Claims, 14 Drawing Sheets

SHELLED CONNECTOR MOUNTED ON ELECTRIC EQUIPMENT

BACKGROUND OF THE INVENTION

1. Field of the Invention

This invention relates to an electric connector for electric equipment, particularly to an internal connector having a conducting shell mounted on the electric equipment, which is to mate with an external connector associated with an external cable.

2. Description of the Related Art

It has recently been required that a connector mounted on electric equipment, for lower cost and better portability be embedded in a chassis of the electric equipment, that is an internal connector. The cable connector is inserted into the mounted connector though a hole in the chassis, that is an external connector associated with an external cable is connected to the mounted connector. The internal connector has a conducting shell for an electrostatic shield against an electric field caused by high frequency signals from the electronic equipment. The shell encapsulates the entire surface of the connector except surfaces on which internal and external terminals are arranged. FIG. 1 shows a conventional connector 1 consisting of an external connector 11 associated with a cable 11*a* and an internal connector 12 having a shell 14 mounted on a chassis panel 16. The external connector 11 having an array of jacks on a front hollow is connected to external electric equipment (not shown) by the cable 11*a*. The internal connector 12 is composed of a connector body 13, an insulating mold 13*b*, an array of plugs 13*a* arranged on a front surface of the insulating mold 13*b* and the conducting shell 14 surrounding the array of plugs 13*a*. The shell 14 also has a pair of lugs 14*b* with a through hole 14*c* on each of them which fixes the shell to the front surface of the insulating mold 13*b* by a bolt. The connector body 13 is fixed on a circuit board 15 at an edge 15*a* where the circuit board 15 is fixed in perpendicular to the chassis panel 16 and in parallel to the plugs 13*a*. When the cable connector 11 is inserted in the internal connector 12 along the direction as indicated by an arrow G, each of the plugs 13*a* in the internal connector 12 mates with the corresponding one of the jacks in the cable connector to establish an electric connection between the external electric equipment and the electric equipment in interest. FIG. 2 illustrates how to ground the internal connector 12 to the chassis panel 16. In the first step, the internal connector 12 is fixed to the insulated front surface of the circuit board 15 by screwing a bolt 19*a* into a nut (not shown) at a through hole 15*c* on each side along the direction denoted by an arrow A such that each terminal of the plugs 13*a'* coincides with the corresponding terminal 15*b* of the circuit laid down on the front surface of the circuit board 15 for soldering. In the second step, the shell is fixed to the chassis panel 16 by a bolt 19*b* through a through hole 16*b* and 14*c* on each side such that the shell 14 is inserted into a window 16*a* of the chassis panel 16 along the direction denoted by an arrow B. Thus, since the conducting shell is internally connected with the ground terminal, the chassis panel 16 is grounded by contacting the lugs of the conducting shell 14 to the back surface of the chassis panel 16.

FIGS. 3A through 3D illustrate another conventional connector 2 consisting of an internal shelled connector 22 and an external cable connector 21. The external cable connector 21 is connected to external electric equipment (not shown) by a cable 21*a*. The internal shelled connector 22 is composed of a connector body 23 shown in FIG. 3B and a conducting shell 24 shown in FIG. 3D.

The connector body 23 is composed of an insulating mold 232, an array of plugs 231, and an external plug terminal 231*b*. The array of plugs 231 is arranged such that each of the plug terminals 231*a* is to mate with the corresponding jack terminal in an array of jacks (not shown) of the external cable connector 21, which is extended to the external plug terminal 231*b* as shown in FIG. 3C, which is sticking out of the insulating mold 232 arranged perpendicular to the plug terminal 231*a*. The insulating mold 232 is formed by an insert mold method such that the array of plugs 231 is surrounded by insulating walls 232*a* and 232*c*. Further, the insulating mold 232 has a rectangular boss 232*b* on each side of both walls 232*a*. As shown in FIG. 3D, the shell 24 is formed by holding a single sheet of patterned aluminum such that all of the outer surfaces of the connector body 23 are encapsulated except the front opening in which the cable connector 21 is to be inserted, a part of the bottom surface on which an array of the external plug terminals 231*b* is arranged, and a rectangular opening 24*a* on each of both side walls to which the rectangular boss 232*b* is engaged. The shell 24 has a pair of outwardly curved legs 24*b* on both sides extending to the same direction as that of the external plug terminals 231*b* by which the internal shelled connector 22 is temporarily fixed to the circuit board as described in detail later. Thus, the internal shelled connector 22 will be built as shown in FIG. 3A by inserting the connector body 23 into the shell 24 such that the rectangular boss 232*b* is engaged with the rectangular opening 24*a* on each of both side walls 232*a*.

FIG. 4A and 4B show how to mount the internal shelled connector 22 on the electric equipment and how to ground the chassis panel 26 to the internal shelled connector 22, respectively. First, the internal shelled connector 22 is mounted near the edge 25*a* of the circuit board 25 such that an array of the external plug terminals 231*b* and a pair of outwardly curved legs 24*b* are inserted into the through holes 25*b* and 25*c* to be fixed, respectively. Next, the circuit board 25 is fixed to the chassis panel 26 by screwing a bolt 27 into a through hole 25*e* on the circuit board 25 and an adjustable channel 26*c* on a plate 26*b* extended perpendicularly to the chassis panel 26 with a nut 28 such that the front surface of the shell 24 is aligned to the back surface of the chassis panel 26 on a periphery of the opening 26*a* to expose the array of plugs 231*b* therein by sliding the bolt in the adjustable channel 26*c* along the direction of a bilateral arrow D.

The through holes 25*b* and 25*c* are connected to the corresponding signal terminals (not shown) and a ground terminal 25*d* on the back surface, respectively. Each of the external plug terminals 231*b* inserted in the through holes 25*b* is soldered to the corresponding signal terminal, and also each of the penetrated outwardly curved legs 24*b* is bent and fixed to the ground terminal 25*d* on the back surface of the circuit board 25. Thus, the ground potential is ensured for the shell 24 by soldering the legs 24*b* to the ground terminals 25*d*. However, since in the shelled connector 12 as shown in FIG. 2, grounding the shell 14 is established only by contacting the lug 14*b* to the chassis panel 16 with screwing a bolt 19*b* and a nut (not shown), an oxidized layer or any insulating foreign material on the contact surface may easily cause instability in an electric contact between the lug 14*b* and the chassis panel 16 and even disconnection of the shell 14 to the ground potential. Since in the shelled connector 22 as shown in FIG. 4A, grounding the shell 14 is established by soldering the legs 24*b* to the ground terminals 25*d*, it is needed to form the ground terminals 25*d* on the back surface of the circuit board 25 solely for this purpose, and also a shell material is limited to metals that can be soldered.

SUMMARY OF THE INVENTION

An object of the present invention is to provide a shelled connector mounted on electrical equipment in which the shell has a flange playing a role of an electrical contact with a grounded chassis panel to ensure the ground potential for the shell without requiring an extra circuit pattern on the circuit board and related processing steps for the ground potential to the shell.

Another object of the present invention is to provide a shelled connector mounted on electric equipment in which the shell has an elastic lug pressing the flange to a grounded chassis panel to increase reliability in the ground potential for the shell.

BRIEF DESCRIPTION OF THE DRAWINGS

The present invention will be more apparent from the following description, when taken to conjunction with the accompanying drawings, in which.

DESCRIPTION OF THE PREFERRED EMBODIMENTS

Reference will now be made in detail to the preferred illustrated embodiments of the invention, examples of which are illustrated in the accompanying drawings. While the invention will be described in conjunction with the preferred illustrated embodiments, it will be understood that they are not intended to limit the invention to these embodiments. On the contrary, the invention is intended to cover alternatives, modifications and equivalents, which may be included within the spirit and scope of the invention as defined by the appended claims.

In all embodiments, the internal and external connectors according to the present invention are essentially the same as those of prior art except the shell structure and the method for grounding the shell to the grounded chassis panel of electrical equipment.

Figure 1:
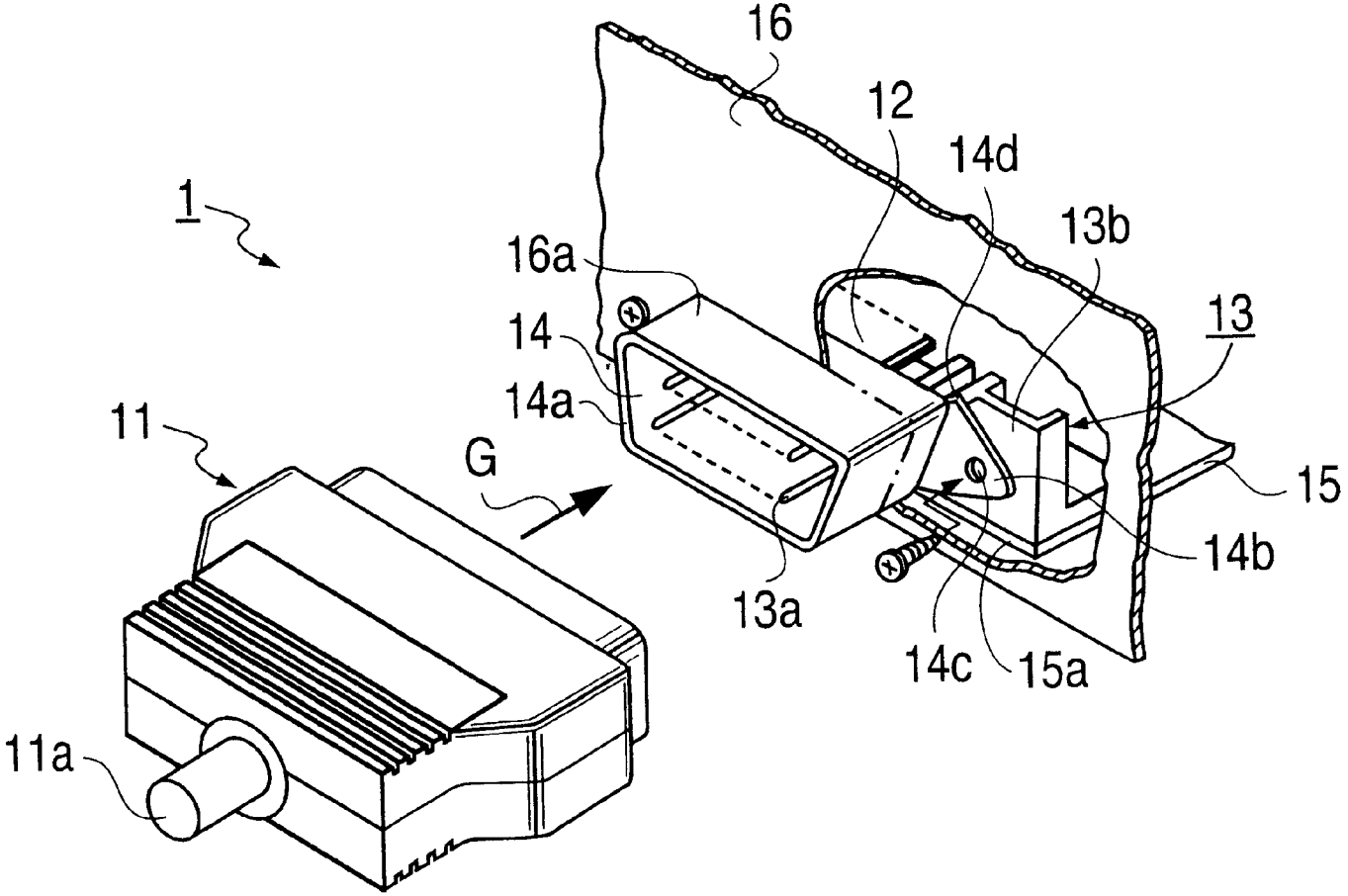
FIG. 1 (PRIOR ART)
FIG. 1 is a bird's eye view of a conventional internal shelled connector mounted on a chassis panel with a partial cutaway, and together with an external cable connector.
Figure 5A:
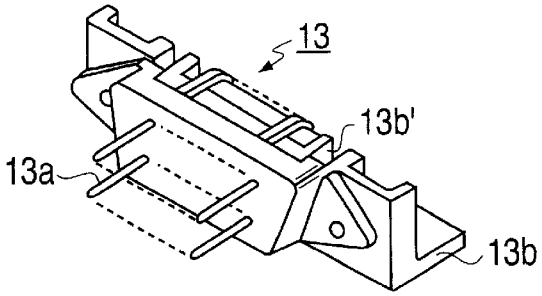
FIG. 5A is a bird's eye view of a connector body for an internal shelled connector.
Figure 5B:
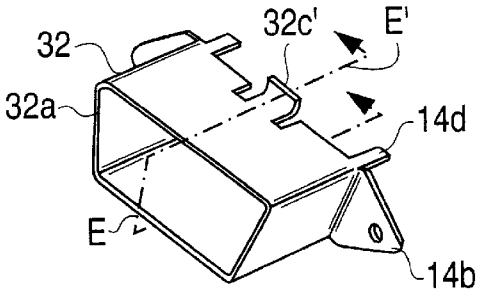
FIG. 5B is a bird's eye view of a shell for the first embodiment according to the present invention for the connector body shown in FIG. 5A.
Figure 5C:
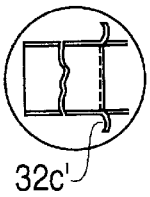
FIG. 5C is a sectional view of the shell taken along a line E–E' shown in FIG. 5B.
Figure 5D:
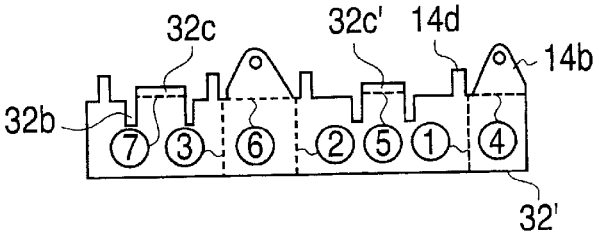
FIG. 5D is a development for the shell shown in FIG. 5B.

FIGS. 5A through 5D illustrate the first embodiment of an internal shelled connector according to the present invention. The connector body 13 shown in FIG. 5A has an array of plug terminals 13*a* and the insulator 13*b* which has a pair of grooves 13*b'* into which lugs 14*d* of the shell 14 fit. These are identical to those shown in FIG. 1. In FIG. 5B, a shell 32 has a conducting wall 32*a* having four sides which is to surround the array of plug terminals 13*a* of the connector body 13 to shield an electrostatic noise, a pair of triangular lugs 14*b* on both sides by which the shell is to be screwed down on the connector body 13 on each side, a pair of rectangular lugs 14*d* each of which is to be bent into the groove 13*b'* of the insulator 13*b* to fix the shell to the insulator 13*b*, and a pair of small flanges 32*c'* on the upper and lower sides of the wall 32*a*. The flange 32*c'* is a structural feature of the shell for the first embodiment according to the present invention. FIG. 5C illustrates a shape and positions of the flanges 32*c'* on the shell. The flanges 32*c'* are slightly curved inwardly such that the flanges 32*c'* are positioned on the same plane as a plane on which the triangular lugs 14*b* are positioned. FIG. 5D shows a development of the shell. A developed pattern of a conducting plate 32' is built into the shell by folding the conducting plate along dotted lines denoted by 1 through 7, such that a ridge is formed on each of the dotted lines 1 through 3, while a trough is formed on each of the dotted lines 4 through 7. The development has a pair of lugs 32*c* each of which has a slit 32*b* on each side, and the flange 32*c'* at a top.

Figure 6A:
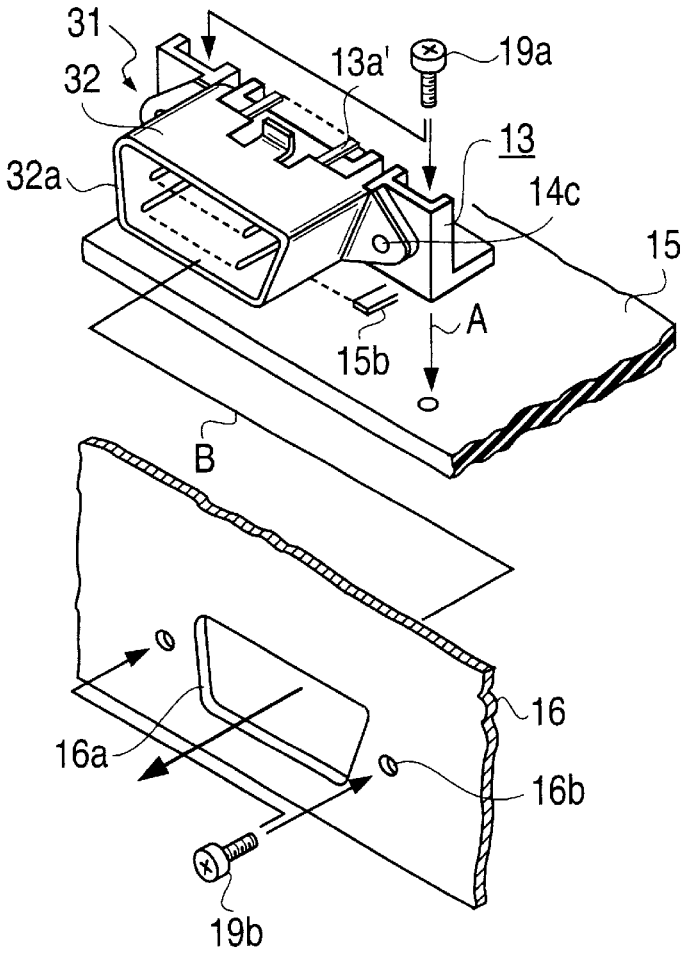
FIG. 6A is an exploded view illustrating how to mount an internal shelled connector having the shell shown in FIG. 5B on a chassis panel and a circuit board.
Figure 6B:
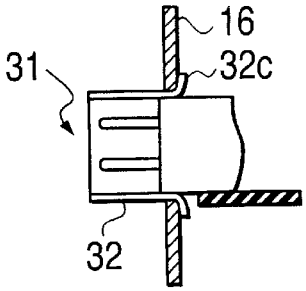
FIG. 6B is a partial sectional view of the shelled connector shown in FIG. 6A after being mounted.

Thus, as shown in FIG. 6A, the shelled connector 31 is screwed down on both a circuit board 15 having an array of terminals 15*b* patterned on the surface of the circuit board and a chassis panel 16 by a pair of bolts 19*a* along the direction denoted by an arrow A and another pair of bolts, 19*b* through a pair of through holes 16*b* and a pair of through holes 14*c* of the triangular lugs 14*b,* respectively. Further, the wall 32*a* of the shell 32 comes out of a window 16*a* on the chassis panel 16 along the direction denoted by an arrow B such that the upper and lower flanges 32*c'* are pressed to the back surface of the chassis panel 16 as shown in FIG. 6B, by which the shell is ensured for a stable electric contact to the grounded chassis panel.

Figure 7A:
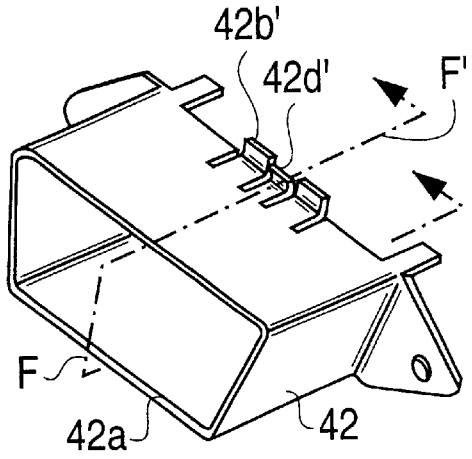
FIG. 7A is a bird's eye view of a shell of an internal shelled connector for the second embodiment according to the present invention.
Figure 7B:
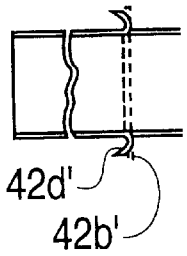
FIG. 7B is a sectional view of the shell taken along a line F–F' shown in FIG. 7A.
Figure 7C:
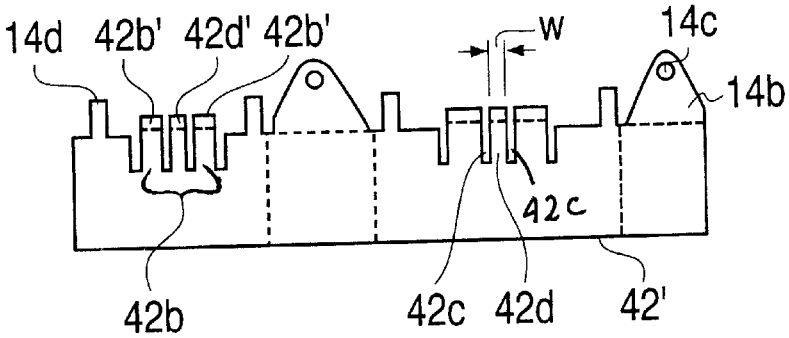
FIG. 7C is a development for the shell shown in FIG. 7A.

FIGS. 7A through FIG. 7C illustrate the second embodiment of an internal shelled connector according to the present invention, which is intended to provide higher reliability on the ground contact of the shell than the first one. FIG. 7A shows a shell 42 having a wall 42*a,* two flanges 42*b'* and a flange 42*d'* between the two flanges 42*b'*. FIG. 7B is a sectional view of the shell 42 along a line F–F', which shows a relative shape and position on each of the flanges 42*b'* and 42*d',* in which it is noticed that the flange 42*d'* is bent at an angle smaller than 90° while each of the flanges 42*b'* has an angle of 90°. As shown in FIG. 7C, a development 42' of the shell is almost the same as that in the first embodiment except a pair 42*b* of three lugs 42*b,* 42*d,* each pair having two slits 42*c* between which there is the lug 42*d* having a width w, which is narrow enough to be bent easily. The lugs 42*b* and 42*d* have flanges 42*b'* and 42*d'* at their tops, respectively.

Figure 2:
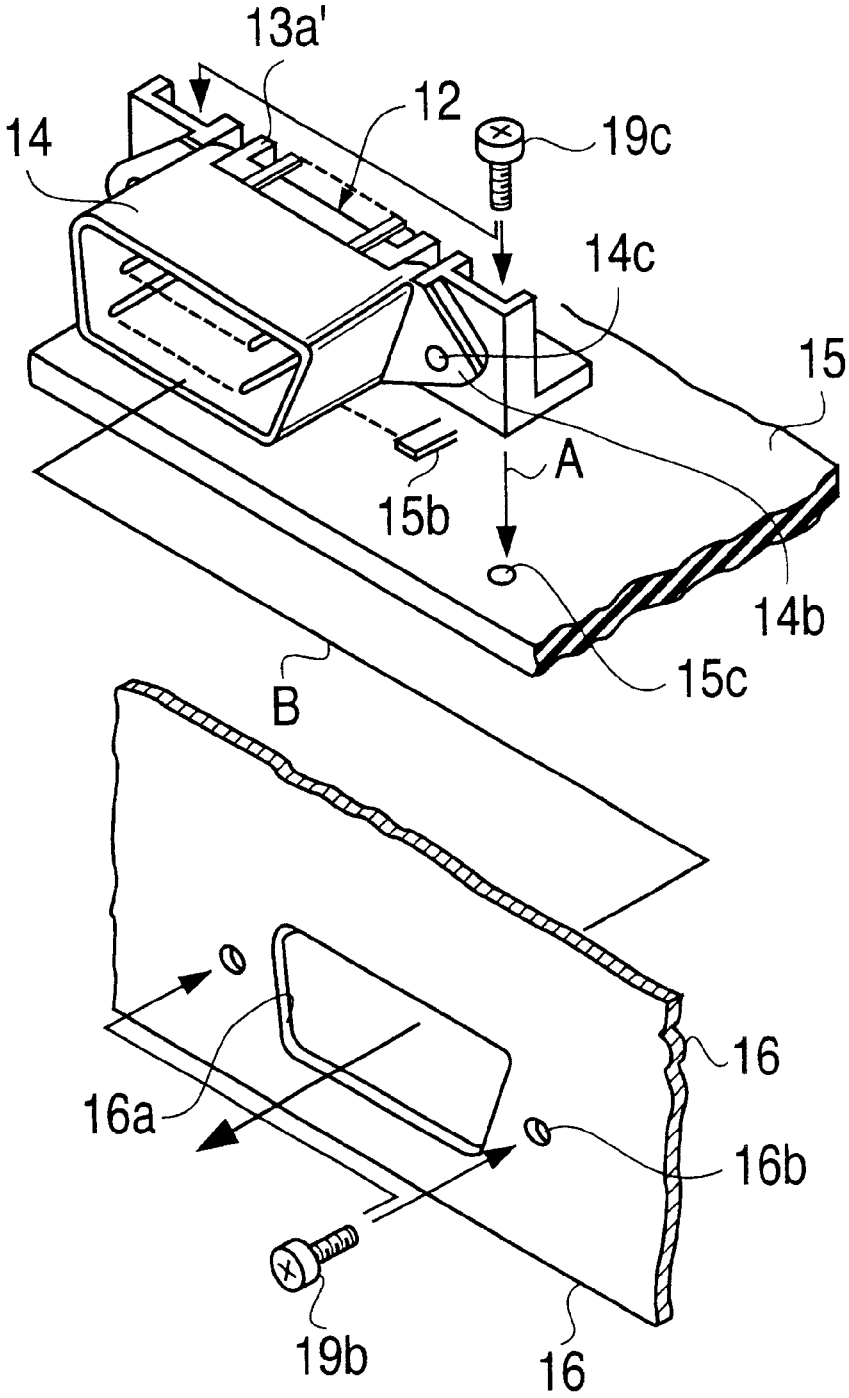
FIG. 2 (PRIOR ART)
FIG. 2 is an exploded view illustrating how to mount the internal shelled connector shown in FIG. 1 on a chassis panel and a circuit board.
Figure 8A:
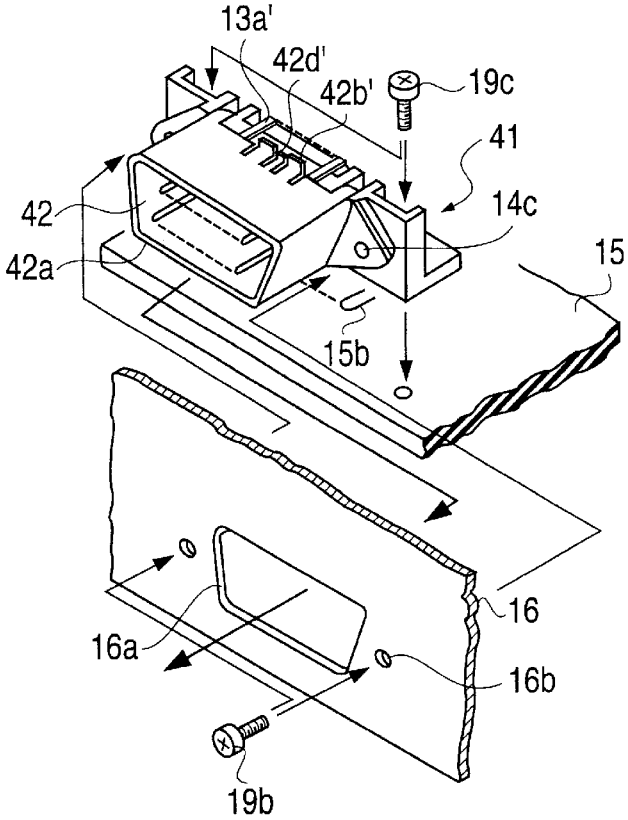
FIG. 8A is an exploded view illustrating how to mount an internal connector having the shell shown in FIG. 7A on a chassis panel and a circuit board.
Figure 8B:
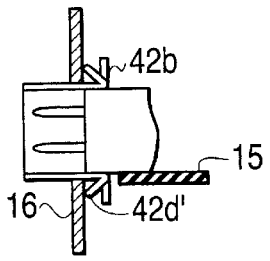
FIGS. 8B and 8C are partial sectional views of the mounted shelled connector shown in FIG. 8A before and after fastening the shell to the chassis panel by using bolts, respectively
Figure 8C:
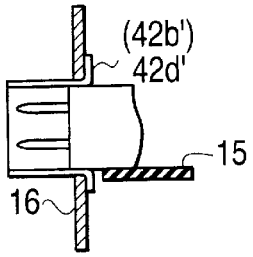

FIGS. 8A through 8C illustrate how to mount the shelled connector 41, which is essentially the same as that of the conventional one shown in FIG. 2 except how to ground the shell to the chassis panel. FIG. 8B is a partial sectional view of the mounted shelled connector 41 shown in FIG. 8A before screwing down the shell 42 on the chassis panel 16 with bolts 19*b*. It should be noticed that the flanges 42*d'* touch the back surface of the chassis panel on the tips and the flanges 42*b'* do not. FIG. 8C shows a partial sectional view of the mounted shelled connector 41 after screwing down the shell 42 on the chassis panel 16, wherein both flanges 42*b'* and 42*d'* seem to touch the back surface of the chassis panel 16 similarly. However, the flanges 42*d'* are pushing the back surface of the chassis panel more strongly due to a spring effect of the flanges 42*d'* than the flanges 42*b'* are. This results in an electric contact between the shell and the chassis panel that is more reliable compared to the shell having a pair of single flanges as shown in FIG. 5C.

Figure 3A:
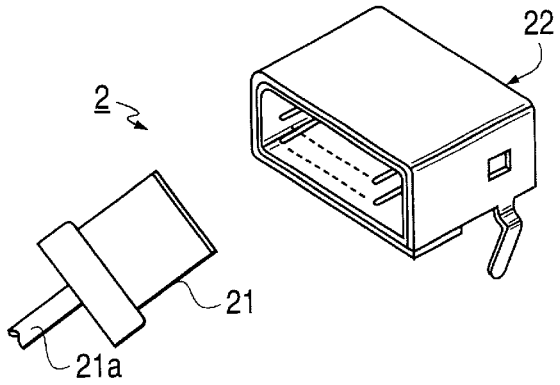
FIG. 3A (PRIOR ART)
FIG. 3A is a bird's eye view of an internal connector having another conventional shell together with an external cable connector.
Figure 3B:
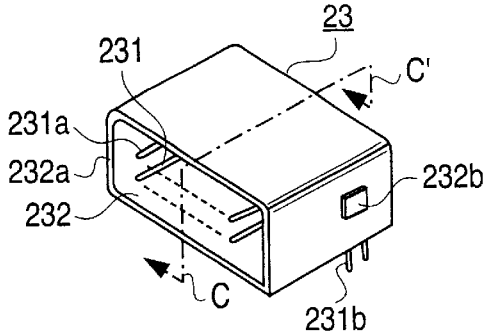
FIG. 3B (PRIOR ART)
FIG. 3B is a bird's eye view of a connector body for the internal shelled connector shown in FIG. 3A.
Figure 3C:
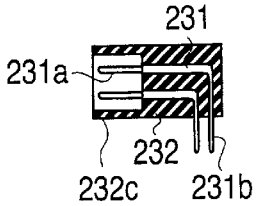
FIG. 3C (PRIOR ART)
FIG. 3C is a sectional view of the connector body taken along a line C–C' shown in FIG. 3B.
Figure 3D:
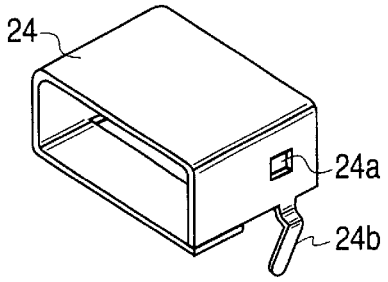
FIG. 3D (PRIOR ART)
FIG. 3D is a bird's eye view of the shell for the internal shelled connector shown in FIG. 3A.
Figure 9:
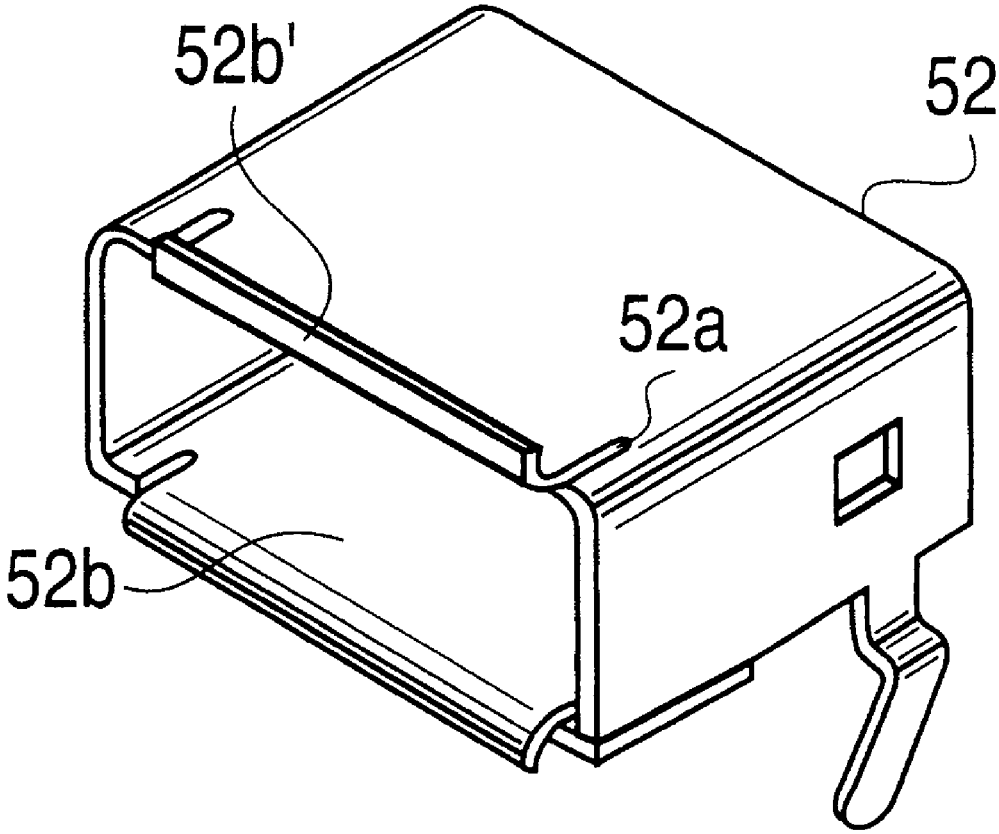
FIG. 9 is a bird's eye view of a shell of an internal shelled connector for the third embodiment according to the present invention.

FIG. 9 is a bird's eye view of a shell of an internal shelled connector 52 for the third embodiment according to the present invention. Only pairs of wide lugs 52*b* and flanges 52*b'* on the upper and the lower surfaces and slits 52*a* on both sides of each lug make the shell 52 different from the conventional one 24 shown in FIG. 3D.

Figure 4A:
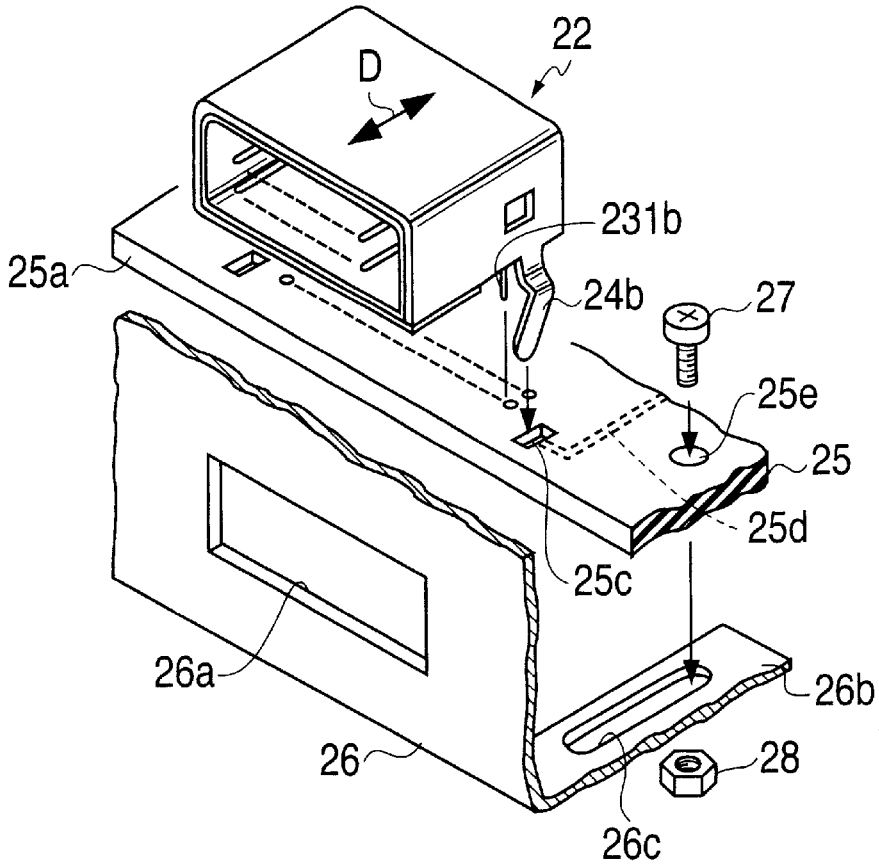
FIG. 4A (PRIOR ART)
FIG. 4A is an exploded view illustrating how to mount the internal shelled connector shown in FIG. 3A on a chassis panel and a circuit board.
Figure 4B:
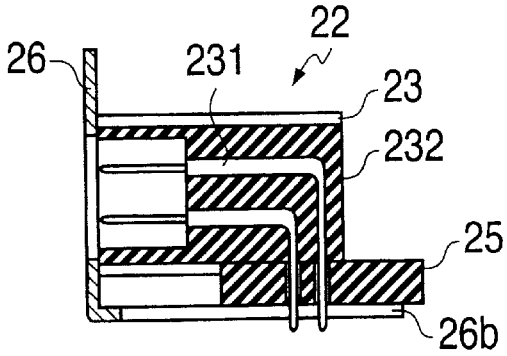
FIG. 4B (PRIOR ART)
FIG. 4B is a sectional view of the internal shelled connector shown in FIG. 4A after being mounted.
Figure 10A:
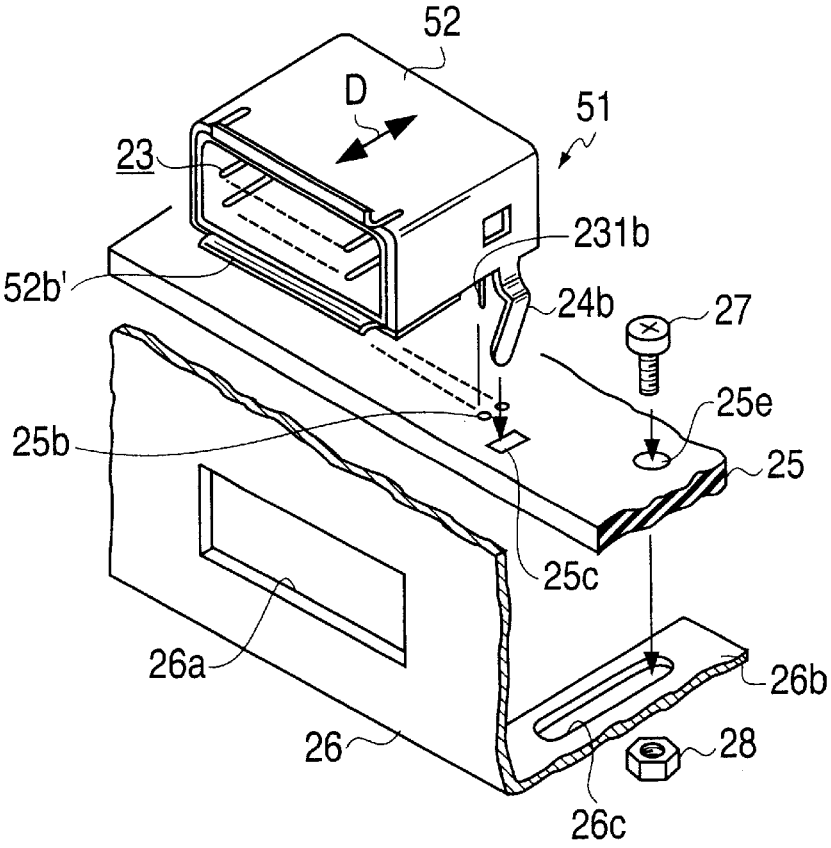
FIG. 10A is an exploded view illustrating how to mount an internal connector having the shell shown in FIG. 9 on a chassis panel and a circuit board.
Figure 10B:
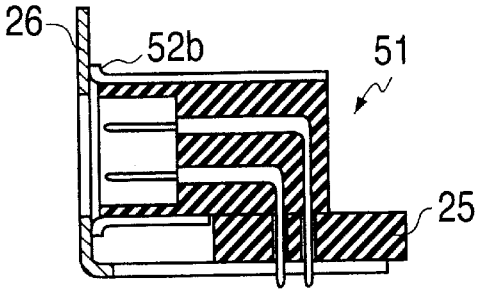
FIG. 10B is a sectional view of the shelled connector shown in FIG. 9 after being mounted.

The difference between FIG. 10A and FIG. 4A aside from their shell structures is that the circuit board 25 in FIG. 10A does not have the ground line 25*d* shown in FIG. 4A. On the other hand, the difference between FIG. 10B and FIG. 4B is that the shell in FIG. 10A has a pair of the flanges 52*b'* and the shell in FIG. 4A does not. Other structural features and their roles are almost the same as those of the prior art described on FIG. 4A and 4B. Namely, as shown in FIG. 10A, the internal shelled connector 51 is mounted on the circuit board 25 such that an array of the external plug terminals 231*b* and a pair of outwardly curved legs 24*b* are inserted into the through holes 25*b* and 25*c* to be fixed, respectively, and then each of the external plug terminals 231*b* is soldered to the corresponding signal terminal, and on being inserted, also a pair of the outwardly curved legs 24*b* fix the shell 52 to the circuit board 25 firmly due to the spring effect. In FIG. 10A, the shelled connector 51 is fixed to the chassis panel 26 by sliding the shelled connector 51 on the circuit board 25 along the direction D and screwing down the circuit board 25 with a bolt 27 and nut 28 through the adjustable channel 26*c* on a long plate 26*b* extended perpendicularly to the chassis panel 26 such that the flanges 52*b'* press the chassis panel 26 strongly enough to establish a good electric contact between them.

Figure 11:
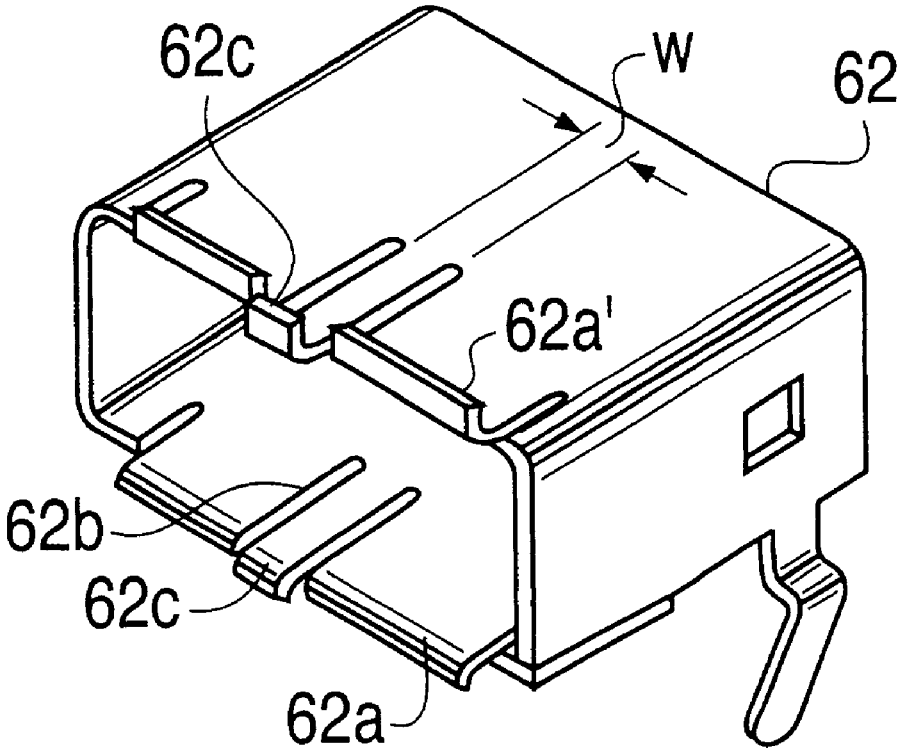
FIG. 11 is a bird's eye view of a shell of an internal shelled connector for the fourth embodiment according to the present invention.

FIG. 11 is a bird's eye view of a shell of an internal shelled connector for the fourth embodiment according to the present invention. This is a modified form of the shell 52. The shell 62 has a pair of wide lugs 62*a* and a narrow lug 62*c* having a width w on each of the upper and lower sides. Both lugs are divided by a pair of slits 62*b*. Further, the lug 62*a* and lug 62*c* have a wide flange 62*a'* and a narrow flange 62*c'* on each of their tips, respectively. What makes the shell 62 different in structure from the shell 52 is that the narrow flange 62*c'* is projected out of the wide flange 62*a'*. The flange 62*c'* is narrow enough to be bent more easily than the wide flange 62*a'*.

Figure 12A:
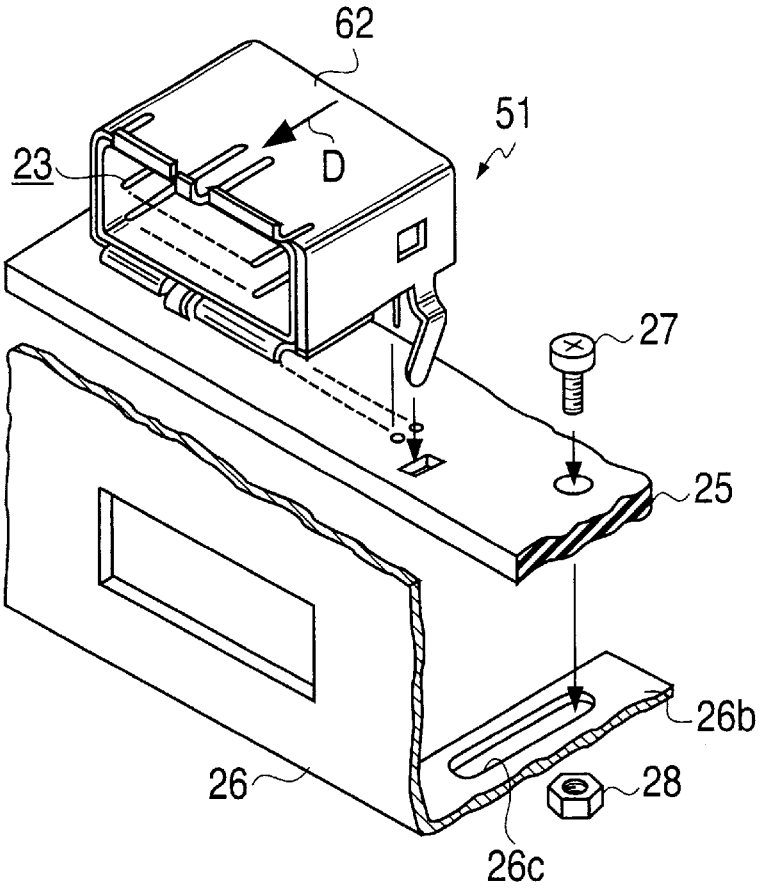
FIG. 12A is an exploded view illustrating how to mount an internal connector having the shell shown in FIG. 11 on a chassis panel and a circuit board.
Figure 12B:
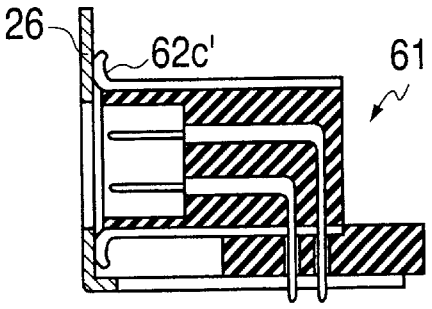
FIG. 12B is a sectional view of the shelled connector shown in FIG. 11 after being mounted.

The shelled connector 61 is fixed to the circuit board by the same way as the shelled connector 51. As shown in FIG. 12B, the flange 62*c'* forms a slide contact to the chassis panel 26 which results in maintaining a better electric contact by a constant pressure due to a stronger spring effect of the flange 62*c'*.

Figure 13:
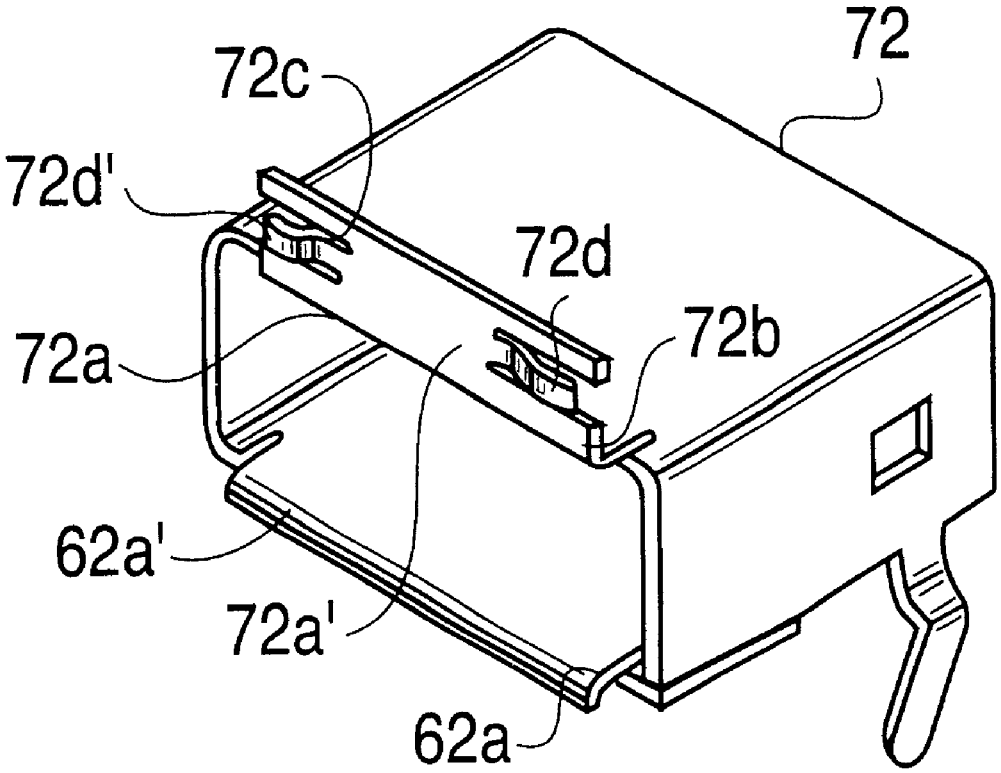
FIG. 13 is a bird's eye view of a shell of an internal shelled connector for the fifth embodiment according to the present invention.

FIG. 13 is a bird's eye view of a shell of an internal shelled connector for the fifth embodiment according to the present invention. The shell 72 has wide lugs 62*a* and 72*a* on the lower and upper sides, respectively. Further, the lugs 62*a* and 72*a* have flanges 62*a'* and 72*a'* on their tips, respectively. These structural features are the same as those of the third embodiment as shown in FIG. 9. However, the flange 72*a'* of the shell 72 has a pair of parallel slits 72*c* perpendicular to each side 72*b* of the lug 72*a,* which forms a finger shaped slide contact 72*d* on each side 72*b*. Each tip 72*d'* of the finger shaped slide contacts 72*d* is projected out of the plane of the flange 72*a'* such that the tips 72*d'* make contact with the chassis panel in advance of any other place of the flange 72*a'* when the internal shelled connector is mounted on the chassis panel.

Figure 14A:
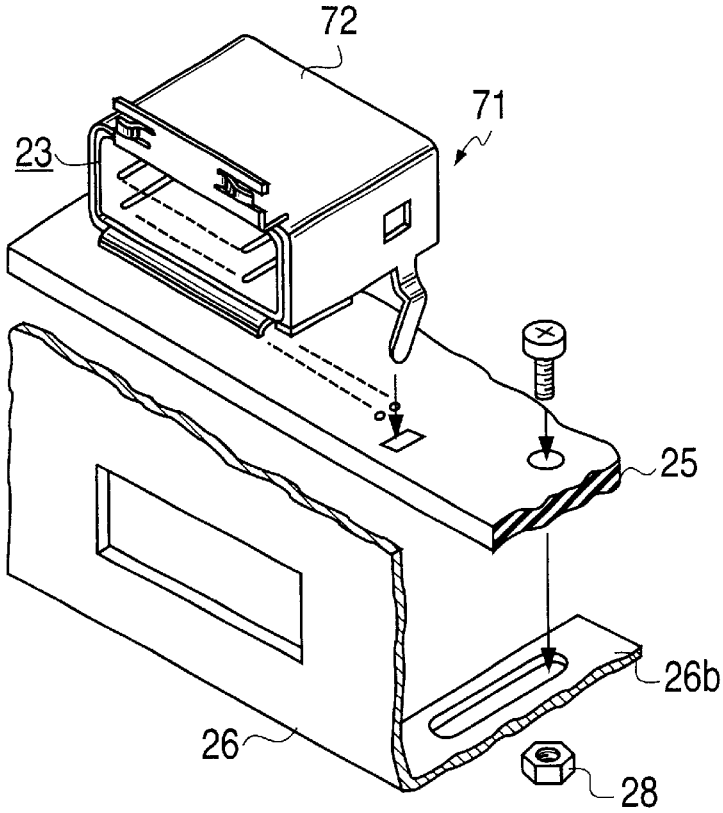
FIG. 14A is an exploded view illustrating how to mount an internal connector having the shell shown in FIG. 13 on a chassis panel and a circuit board.
Figure 14B:
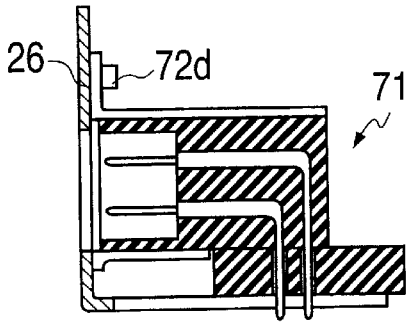
FIG. 14B is a sectional view of the shelled connector shown in FIG. 13 after being mounted.

FIGS. 14A and 14B illustrate how to mount the internal shelled connector 71 on the circuit board 25 and the chassis panel 26. Particularly, FIG. 14B shows that the finger shaped slide contact 72*d* seems to have a contact with the chassis panel on the same plane as the other part of the flange 72*a'*. However, the finger shaped slide contact 72*d* pushes the chassis panel more strongly than the other part of the flange 72*a'* does. Consequently, the finger shaped slide contact 72*d* maintains a persistent electric contact with the grounded chassis panel even if a variation in distance between the grounded chassis panel and the mounted shelled connector may be caused by mechanical stress at a time of plugging in or pulling out the external cable connector.

What is claimed is:

1. A first electrical connector for connecting to a second electrical connector, the first connector comprising:

a connector body having an insulated body and including a terminal having a first end located at a first portion of the body, and a second end located at a second portion of the body, wherein the first end electrically connects to the second connector and the second end electrically connects with a circuit board;

a conducting shell having first and second opposing planar walls, and side walls, and which is mountable on the insulated body and on a grounded chassis, is hollow, includes a first open end, a second open end, said planar walls between the first and second ends defining an area, and a central axis extending from the first open end to the second open end, wherein the first open end receives the first portion of the body, and the second open end receives the second connector, wherein a periphery of one of the first end and second end of the shell includes first and second adjacent projections for connecting the conducting shell and the grounded chassis in grounded electrical relationship, wherein each of said projections has a first portion formed integrally of one of the planar walls of the shell, a second portion integrally formed with the first portion and being formed co-planar with and within an area defined by said wall, but spaced from said wall and the other projection, by slits formed in said wall, and a third portion which is integrally formed with the second portion, but extends substantially perpendicularly thereto and beyond the area defined by said wall in the axial direction, wherein one of the projections extends in the axial direction further than the other of the projections, and wherein the first and second portions of each projection biases the third portion of each projection against the grounded chassis, when the conducting shell is mounted on the grounded chassis.

2. The first connector according to claim 1, wherein the first and second adjacent projections are formed on each of the opposing planar walls.

3. The first connector according to claim 1, wherein the third portion of each projection is a flange.

4. The first connector as recited in claims 1, wherein the first and second projections share a single slit between them.

5. The first connector as recited in claim 1, further comprising a third projection formed on the periphery of the other one of the planar walls, for connecting the conducting shell and the grounded chassis in grounded electrical relationships.

6. The first connector as recited in claim 1, wherein the conducting shell is made of sheet aluminum.

7. The first connector according to claim 1, wherein the conducting shell projects forwardly through a window formed in the grounded chassis, the second open end of the conducting shell is disposed in front of the grounded chassis for receiving the second connector, and the first and second adjacent projections extend forwardly from the first open end of the conducting shell.

* * * * *